US007066849B2

(12) United States Patent
Budaj

(10) Patent No.: US 7,066,849 B2
(45) Date of Patent: Jun. 27, 2006

(54) PORTABLE TRAINING DEVICE FOR SOCCER PLAYERS

(76) Inventor: Matthew C. Budaj, 2114 Manchester Rd., Glastonbury, CT (US) 06033

( * ) Notice: Subject to any disclaimer, the term of this patent is extended or adjusted under 35 U.S.C. 154(b) by 0 days.

(21) Appl. No.: 10/979,036

(22) Filed: Nov. 2, 2004

(65) Prior Publication Data

US 2006/0094543 A1 May 4, 2006

(51) Int. Cl.
*A63B 69/00* (2006.01)

(52) U.S. Cl. ..... 473/446; 473/422; 473/419

(58) Field of Classification Search ..... 473/422, 473/446, 438, 416–419; 434/251, 247
See application file for complete search history.

(56) References Cited

U.S. PATENT DOCUMENTS

| | | | | |
|---|---|---|---|---|
| 2,382,744 | A * | 8/1945 | Whalen | 434/251 |
| 3,080,859 | A * | 3/1963 | Benkoe | 124/64 |
| D217,725 | S | 6/1970 | Glantz et al. | |
| 4,512,578 | A | 4/1985 | Dalton | |
| 4,720,095 | A * | 1/1988 | Sowards | 473/423 |
| 4,795,164 | A | 1/1989 | Morpeau | |
| 4,865,330 | A * | 9/1989 | D'Amico | 473/420 |
| 4,943,055 | A | 7/1990 | Corley | |
| 5,037,113 | A * | 8/1991 | Sowards | 473/423 |
| 5,100,135 | A * | 3/1992 | Bourgeois | 473/420 |
| 5,435,572 | A * | 7/1995 | Covel | 473/423 |
| 5,501,454 | A * | 3/1996 | Frantz | 473/420 |
| 5,655,776 | A * | 8/1997 | Kaulfuerst | 473/187 |
| 5,660,550 | A * | 8/1997 | Roche | 473/427 |
| 5,669,833 | A | 9/1997 | Stone | |
| 5,746,669 | A * | 5/1998 | Sinsheimer et al. | 473/446 |
| 5,951,414 | A | 9/1999 | Sowards | |
| 6,402,647 | B1 | 6/2002 | Haseltine | |
| 6,475,108 | B1 * | 11/2002 | Sarenana et al. | 473/420 |
| 2004/0254035 | A1 * | 12/2004 | Hoffman | 473/423 |

* cited by examiner

*Primary Examiner*—Mitra Aryanpour

(57) ABSTRACT

A soccer training device includes a base member including a flexible handle for assisting a user to transport the device between remote locations. A plurality of mounting brackets are removably securable to the base member and a plurality of bearings are operably attached to the mounting brackets respectively. The bearings have substantially spherical shapes and are equidistantly spaced adjacent opposed corners of the base member. The device includes a spherical body removably positionable on the bearings and centered therebetween. The spherical body is provided with a cavity and a threaded opening passing thereto. The device includes a body for selectively altering a weight of the spherical body. The weight altering body includes a solid pin removably insertable into the cavity. A fastening member is threadably insertable into the opening for contacting the pin such that the fastening member assists to maintain the pin at a fixed position during operating conditions.

18 Claims, 2 Drawing Sheets

PORTABLE TRAINING DEVICE FOR SOCCER PLAYERS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to sport's training devices and, more particularly, to a portable, soccer training device for improving feet-eye coordination.

2. Prior Art

Numerous approaches have been provided in the prior art for training athletes in running sports. For example, in order to train athletes in track and/or football, multiple variations have been provided on ribbed runways, whereby the athlete runs across a field with his or her legs on respective sides of a center rib, with cross-members arranged substantially orthogonal thereto, so as to form a grid or a sequence of transverse projections.

In use, the athlete will step over each such cross-member sequentially, thereby requiring the legs of the athlete to be raised by at least a predetermined minimum amount and further requiring fairly accurate step positioning of the feet. None of these known arrangements, however, provide the benefit of training an athlete to handle a soccer ball.

One known approach for achieving an essentially closed training path for improving hockey skills utilizes a plurality of truncated rubber cones, such as traffic cones, arranged such that the athlete can train along a path defined by such conical members. However, an arrangement designed to further the development of hockey athletes is not optimal for soccer training. In soccer, it is desired that the athlete gain proficiency in a number of skills that are peculiar to that game. First, there is the need for the athlete to dribble the soccer ball with his or her feet, requiring the athlete not only to kick the ball, but also to stay in control of it.

Accordingly, a need remains for a soccer training device that facilitates the practice of ball-handling skills by a player. The present invention satisfies such a need by providing a device for teaching soccer players to practice ball-handling skills, specifically turning or spinning the ball with one foot. The present invention will allow a player to develop better control of the ball when preparing to avoid opponents, shoot or pass, without having to look at the ball. Use of such a device would encourage players to keep their heads up during game situations, resulting in fewer turnovers and takeaways.

BRIEF SUMMARY OF THE INVENTION

In view of the foregoing background, it is therefore an object of the present invention to provide an apparatus for training soccer players to control a soccer ball while keeping their head up. These and other objects, features, and advantages of the invention are provided by a training device for assisting an athlete to improve foot-eye coordination when dribbling a soccer ball. The device includes a base member having substantially planar top and bottom surfaces and a centrally disposed longitudinal axis. An outer layer is disposed about the top and bottom surfaces of the base member for providing a friction surface.

The base member preferably further includes oppositely spaced edge portions equally spaced from the axis and extending parallel thereto along a length of the base member. The base member preferably further includes a flexible handle having opposed end portions connected thereto for assisting a user to transport the apparatus between remote locations. A plurality of mounting brackets are removably securable to the base member and extend upwardly therefrom. The mounting brackets are equidistantly offset from a vertical axis and face inwardly towards a center of the base member. The mounting brackets further include raised lateral edge portions facing away from the center of the base member.

A plurality of bearings may be operably attached to the mounting brackets respectively and preferably face outwardly from the mounting brackets while maintaining an equidistant spatial relationship along the base member such that a rotational movement of a first pair of the bearings induces an opposite and cooperating rotation of a second pair of the bearings respectively. Such bearings have substantially spherical shapes and are equidistantly spaced adjacent opposed corners of the base member.

The device preferably includes a spherical body removably positionable on the bearings and centered therebetween such that the spherical body is caused to rotate about a central axis extending along a substantially vertical plane. The spherical body is provided with a cavity and a threaded opening passing thereto. Such a spherical body may be formed from plastic and sized and shaped for simulating a soccer ball. The device preferably includes a weight altering body for selectively altering a weight of the spherical body. The weight altering body cooperates with the cavity and the opening for assisting to maintain the spherical body at a substantially stable position during operating conditions.

The body preferably further includes a solid pin removably insertable into the cavity. The pin has a predetermined mass associated therewith for controlling the weight of the spherical body. A fastening member is threadably insertable into the opening and is sized and shaped for contacting the pin beneath an outer surface of the spherical body such that the fastening member assists to maintain the pin at a fixed position during operating conditions.

The cavity preferably has a linear length passing from an outer surface of the spherical body and through a center thereof such that the weight of the spherical body can be maintained at equilibrium when the cavity is aligned along the vertical axis. The opening preferably has a linear length and is offset from the vertical axis such that the opening obliquely passes from the outer surface and inwardly towards an outer edge of the cavity.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
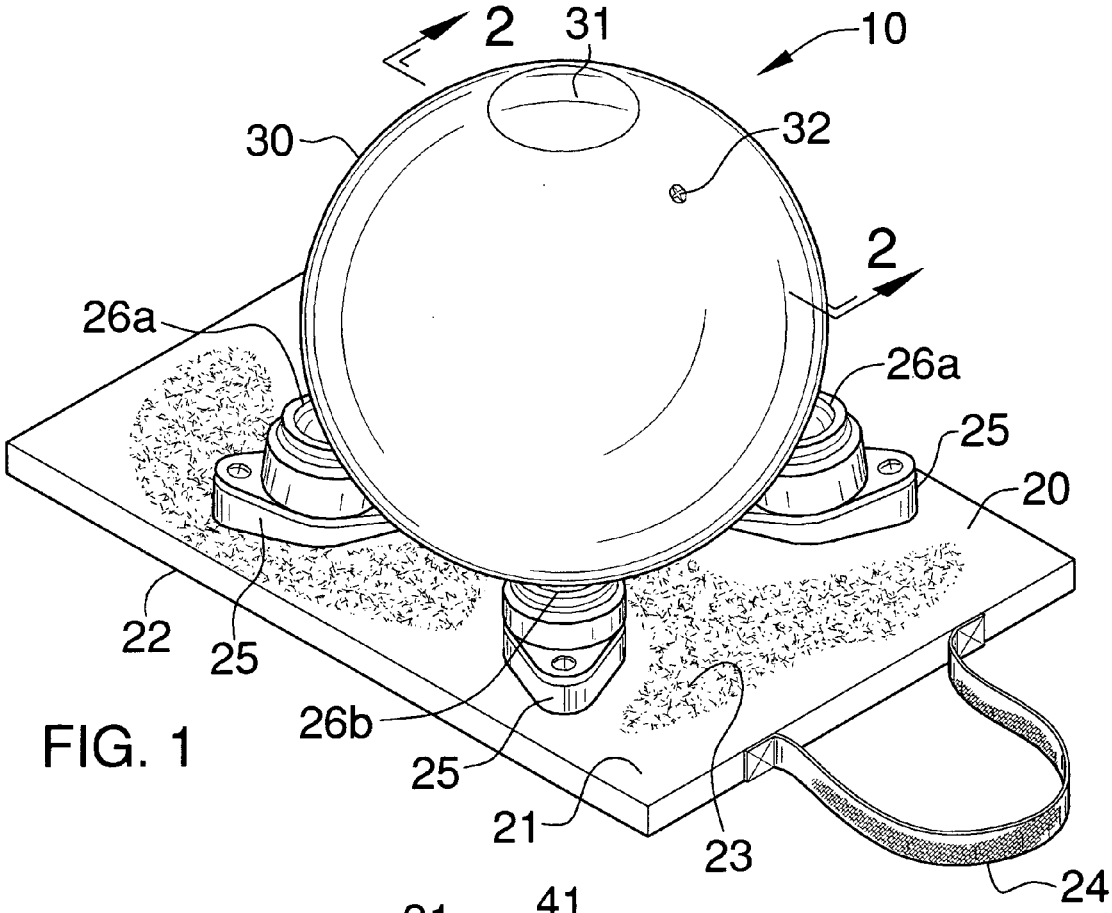
FIG. 1 is a perspective view showing a portable training device for soccer players, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–4 by the reference numeral 10 and is intended to provide a training device for teaching soccer players to keep their head up while handling a soccer ball. It should be understood that the device 10 may be used to train participants in many different sports and should not be limited to only soccer.

Figure 4:
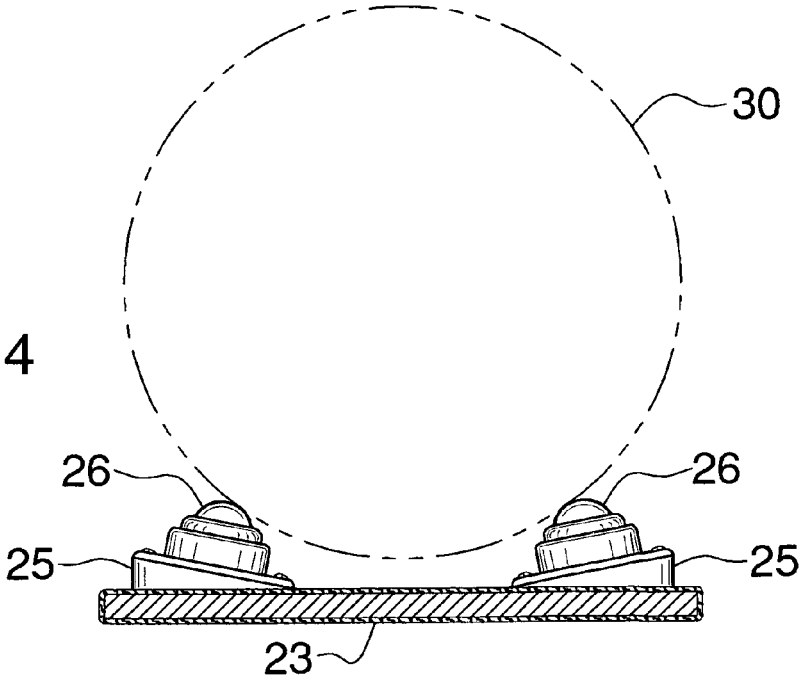
FIG. 4 is a cross-sectional view of the spherical body, shown in a preferred environment.

Initially referring to FIG. 1, the device 10 preferably includes a base member 20 having substantially planar top 21 and bottom 22 surfaces and a centrally disposed longitudinal axis (not shown). An outer layer 23 is disposed about the top 21 and bottom 22 surfaces of the base member 20 for providing a friction surface, as shown in FIG. 4. The friction surface assists in maintaining the device 10 at a substantially stable position during operating conditions.

Referring to FIG. 1, the base member 20 preferably further includes oppositely spaced edge portions equally spaced from the axis and extending parallel thereto along a length of the base member 20. The base member 20 preferably further includes a flexible handle 24 having opposed end portions connected thereto for assisting a user to conveniently transport the device 10 between remote locations, such as practice fields and game sites, for example.

Figure 3:
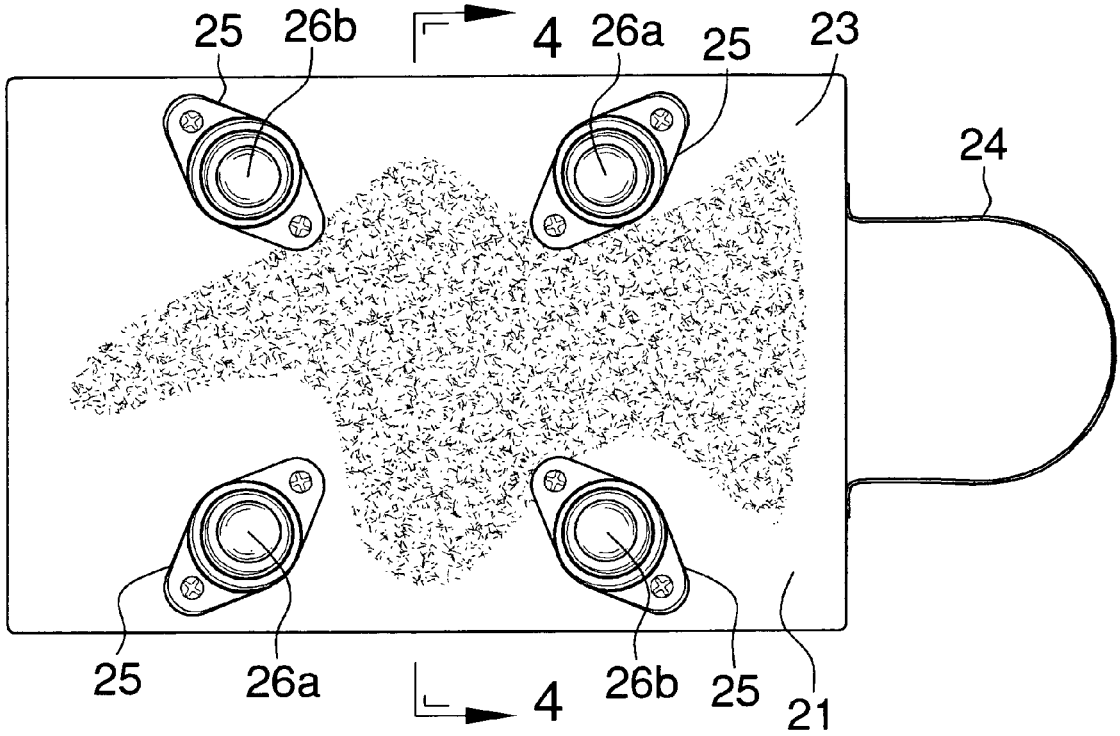
FIG. 3 is a top plan view of the present invention without the spherical body.

A plurality of mounting brackets 25 are removably securable to the base member 20 and extend upwardly therefrom. The mounting brackets 25 are equidistantly offset from a vertical axis and face inwardly towards a center of the base member 20, as shown in FIG. 3. The mounting brackets 25 further include raised lateral edge portions facing away from the center of the base member 25.

A plurality of bearings 26 may be operably attached to the mounting brackets 25 respectively and preferably face outwardly from the mounting brackets 25 while maintaining an equidistant spatial relationship along the base member 20 such that a rotational movement of a first pair of the bearings 26*a* induces an opposite and cooperating rotation of a second pair of the bearings 26*b* respectively. Such bearings 26*a*, 26*b* have substantially spherical shapes and are equidistantly spaced adjacent opposed corners of the base member 20, as best shown in FIG. 3. Such bearings 26*a, b* assist a user in maintaining the spherical body 30 (described herein below) in a stationary position during operating conditions, while still allowing the spherical body 30 (described herein below) to rotate.

Figure 2:
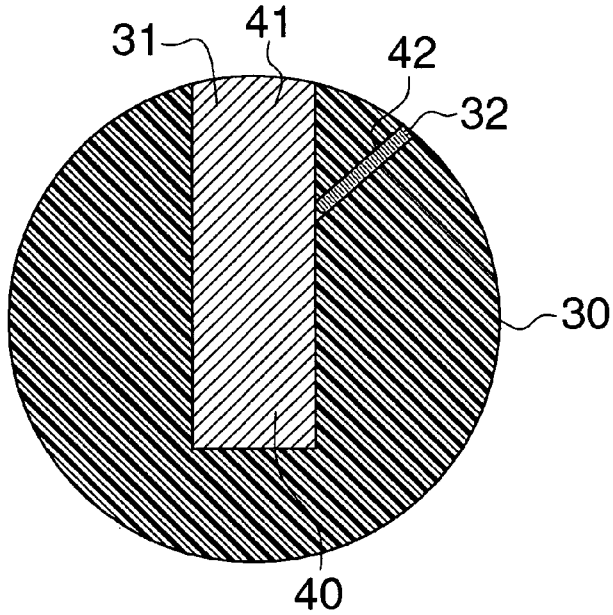
FIG. 2 is a cross-sectional view of the spherical body shown in FIG. 1, taken along line 2—2.

Still referring to FIG. 1, the device 10 preferably includes a spherical body 30, such as a soccer ball well known in the industry, removably positionable on the bearings and centered therebetween such that the spherical body 30 is caused to rotate about a central axis extending along a substantially vertical plane. The spherical body 30 is provided with a cavity 31 and a threaded opening 32 passing thereto, as shown in FIG. 2. Such a spherical body 30 is preferably formed from plastic to resist corrosion in an outdoor environment, and is sized and shaped for simulating a soccer ball.

The device 10 preferably includes a body 40 for selectively altering a weight of the spherical body 30. The weight altering body 40 cooperates with the cavity 31 and the opening 32 for assisting to maintain the spherical body 30 at a substantially stable position during operating conditions, eliminating the need to chase and retrieve a ball. The weighted design of the spherical body 30 provides a degree of resistance that could be used by a player to strengthen the muscles in the feet, ankles, and legs, advantageously enabling a player to increase his/her speed and endurance.

Now referring to FIG. 2, the weight altering body 40 preferably further includes a solid pin 41 removably insertable into the cavity 31. The pin 41 has a predetermined mass associated therewith for controlling the weight of the spherical body 30. Advantageously, the pin 41 may be removed and replaced with gradually heavier pins 41, helping a player gain strength in an incremental manner. A fastening member 42 is threadably insertable into the opening 32 and is sized and shaped for contacting the pin 41 beneath an outer surface of the spherical body 30 such that the fastening member 42 assists to maintain the pin 41 at a fixed position during operating conditions so that it does not rattle or vibrate and cause distracting noises while a player concentrates on his/her footwork.

Still referring to FIG. 2, the cavity 31 preferably has a linear length passing from an outer surface of the spherical body 30 and through a center thereof such that the weight of the spherical body 30 can be maintained at equilibrium when the cavity 31 is aligned along the vertical axis. The opening 32 preferably has a linear length and is offset from the vertical axis such that the opening 32 obliquely passes from the outer surface and inwardly towards an outer edge of the cavity 31.

The device 10 features a compact design that is portable and could be used in virtually any location, indoors and outdoors. It is easy to use, portable and fulfills the need for an effective training aid for soccer players to enhance their skills.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for assisting an athlete to improve foot-eye coordination when dribbling a soccer ball, the apparatus comprising:

a base member having substantially planar top and bottom surfaces and a centrally disposed longitudinal axis, the base member further including oppositely spaced edge portions equally spaced from the axis and extending parallel thereto along a length of the base member;

a plurality of mounting brackets removably securable to the base member and extending upwardly therefrom, the mounting brackets being equidistantly offset from a vertical axis and facing inwardly towards a center of the base member;

a plurality of bearings operably attached to the mounting brackets respectively, said plurality of bearing including a first pair of bearings and a second pair of bearings, the bearings facing outwardly from the mounting brackets and maintaining an equidistant spatial relationship along the base member such that a rotational movement of said first pair of the bearings induces an opposite and cooperating rotation of said second pair of the bearings respectively;

a spherical body removably positionable on the bearings and being centered therebetween such that the spherical body is caused to rotate about a central axis extending along a substantially vertical plane, the spherical body being provided with a cavity and a threaded opening passing thereto; and means for selectively altering a weight of the spherical body, the weight altering means cooperating with the cavity and the opening for assisting to maintain the spherical body at a substantially stable position during operating conditions.

2. The apparatus of claim 1, wherein the weight altering means comprises:

a solid pin removably insertable into the cavity, the pin having a predetermined mass associated therewith for controlling the weight of the spherical body; and a fastening member threadably insertable into the opening, the fastening member being sized and shaped for contacting the pin beneath an outer surface of the spherical body such that the fastening member assists to maintain the pin at a fixed position during operating conditions.

3. The apparatus of claim 1, wherein the cavity has a linear length passing from an outer surface of the spherical body and through a center thereof such that the weight of the spherical body can be maintained at equilibrium when the cavity is aligned along the vertical axis;

the opening having a linear length and being offset from the vertical axis such that the opening obliquely passes from the outer surface and inwardly towards an outer edge of the cavity.

4. The apparatus of claim 1, wherein the bearings have substantially spherical shapes and are equidistantly spaced adjacent opposed corners of the base member.

5. The apparatus of claim 1, wherein the spherical body is sized and shaped for simulating a soccer ball, the spherical body being formed from plastic.

6. The apparatus of claim 1, further comprising: an outer layer disposed about the top and bottom surfaces of the base member for providing a friction surface.

7. An apparatus for assisting an athlete to improve foot-eye coordination when dribbling a soccer ball, the apparatus comprising:

a base member having substantially planar top and bottom surfaces and a centrally disposed longitudinal axis, the base member further including oppositely spaced edge portions equally spaced from the axis and extending parallel thereto along a length of the base member, the base member further including a flexible handle having opposed end portions connected thereto for assisting a user to transport the apparatus between remote locations;

a plurality of mounting brackets removably securable to the base member and extending upwardly therefrom, the mounting brackets being equidistantly offset from a vertical axis and facing inwardly towards a center of the base member;

a plurality of bearings operably attached to the mounting brackets respectively, said plurality of bearing including a first pair of bearings and a second pair of bearings, the bearings facing outwardly from the mounting brackets and maintaining an equidistant spatial relationship along the base member such that a rotational movement of said first pair of the bearings induces an opposite and cooperating rotation of said second pair of the bearings respectively;

a spherical body removably positionable on the bearings and being centered therebetween such that the spherical body is caused to rotate about a central axis extending along a substantially vertical plane, the spherical body being provided with a cavity and a threaded opening passing thereto; and means for selectively altering a weight of the spherical body, the weight altering means cooperating with the cavity and the opening for assisting to maintain the spherical body at a substantially stable position during operating conditions.

8. The apparatus of claim 7, wherein the weight altering means comprises:

a solid pin removably insertable into the cavity, the pin having a predetermined mass associated therewith for controlling the weight of the spherical body; and a fastening member threadably insertable into the opening, the fastening member being sized and shaped for contacting the pin beneath an outer surface of the spherical body such that the fastening member assists to maintain the pin at a fixed position during operating conditions.

9. The apparatus of claim 7, wherein the cavity has a linear length passing from an outer surface of the spherical body and through a center thereof such that the weight of the spherical body can be maintained at equilibrium when the cavity is aligned along the vertical axis;

the opening having a linear length and being offset from the vertical axis such that the opening obliquely passes from the outer surface and inwardly towards an outer edge of the cavity.

10. The apparatus of claim 7, wherein the bearings have substantially spherical shapes and are equidistantly spaced adjacent opposed corners of the base member.

11. The apparatus of claim 7, wherein the spherical body is sized and shaped for simulating a soccer ball, the spherical body being formed from plastic.

12. The apparatus of claim 7, further comprising: an outer layer disposed about the top and bottom surfaces of the base member for providing a friction surface.

13. An apparatus for assisting an athlete to improve foot-eye coordination when dribbling a soccer ball, the apparatus comprising:

a base member having substantially planar top and bottom surfaces and a centrally disposed longitudinal axis, the base member further including oppositely spaced edge portions equally spaced from the axis and extending parallel thereto along a length of the base member, the base member further including a flexible handle having opposed end portions connected thereto for assisting a user to transport the apparatus between remote locations;

a plurality of mounting brackets removably securable to the base member and extending upwardly therefrom, the mounting brackets being equidistantly offset from a vertical axis and facing inwardly towards a center of the base member, the mounting brackets including raised lateral edge portions facing away from the center of the base member;

a plurality of bearings operably attached to the mounting brackets respectively, said plurality of bearing including a first pair of bearings and a second pair of bearings, the bearings facing outwardly from the mounting brackets and maintaining an equidistant spatial relationship along the base member such that a rotational movement of said first pair of the bearings induces an opposite and cooperating rotation of said second pair of the bearings respectively;

a spherical body removably positionable on the bearings and being centered therebetween such that the spherical body is caused to rotate about a central axis extending along a substantially vertical plane, the spherical body being provided with a cavity and a threaded opening passing thereto; and means for selectively altering a weight of the spherical body, the weight altering means cooperating with the cavity and the opening for assisting to maintain the spherical body at a substantially stable position during operating conditions.

14. The apparatus of claim 13, wherein the weight altering means comprises:

a solid pin removably insertable into the cavity, the pin having a predetermined mass associated therewith for controlling the weight of the spherical body; and a fastening member threadably insertable into the opening, the fastening member being sized and shaped for contacting the pin beneath an outer surface of the spherical body such that the fastening member assists to maintain the pin at a fixed position during operating conditions.

15. The apparatus of claim 13, wherein the cavity has a linear length passing from an outer surface of the spherical body and through a center thereof such that the weight of the spherical body can be maintained at equilibrium when the cavity is aligned along the vertical axis;

the opening having a linear length and being offset from the vertical axis such that the opening obliquely passes from the outer surface and inwardly towards an outer edge of the cavity.

16. The apparatus of claim 13, wherein the bearings have substantially spherical shapes and are equidistantly spaced adjacent opposed corners of the base member.

17. The apparatus of claim 13, wherein the spherical body is sized and shaped for simulating a soccer ball, the spherical body being formed from plastic.

18. The apparatus of claim 13, further comprising: an outer layer disposed about the top and bottom surfaces of the base member for providing a friction surface.

* * * * *